US011457737B1

(12) United States Patent
Stempky et al.

(10) Patent No.: US 11,457,737 B1
(45) Date of Patent: Oct. 4, 2022

(54) DRAWER GLIDE FOR OVEN BOTTOM DRAWER

(71) Applicant: Haier US Appliance Solutions, Inc., Wilmington, DE (US)

(72) Inventors: Lydia Stempky, Louisville, KY (US); John Adam Yantis, Prospect, KY (US)

(73) Assignee: Haler US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/197,745

(22) Filed: Mar. 10, 2021

(51) Int. Cl.
*A47B 88/403* (2017.01)
*A47B 88/497* (2017.01)
*A47B 88/417* (2017.01)

(52) U.S. Cl.
CPC ..... *A47B 88/497* (2017.01); *A47B 88/403* (2017.01); *A47B 88/417* (2017.01); *A47B 2210/07* (2013.01)

(58) Field of Classification Search
CPC ... A47B 88/403; A47B 88/417; A47B 88/497; A47B 2210/07
USPC ..... 312/334.1, 334.27, 334.31
See application file for complete search history.

(56) References Cited

U.S. PATENT DOCUMENTS 2,586,138 A 2/1952 Zaltzman
2,698,214 A * 12/1954 Skamser ..... A47B 88/407 312/334.5
3,211,510 A * 10/1965 Hahn ..... A47B 88/483 312/334.31
3,328,107 A 6/1967 Gutner
3,897,981 A * 8/1975 Kaplan ..... A47B 88/483 384/23
3,929,386 A * 12/1975 Read ..... A47B 88/483 384/22
4,389,079 A * 6/1983 Cosme ..... A47B 88/483 312/334.36
4,449,766 A * 5/1984 Shook ..... A47B 88/483 312/332
4,534,600 A * 8/1985 Cosme ..... A47B 88/483 384/23
4,759,341 A * 7/1988 McFarland ..... F24C 15/168 126/339

FOREIGN PATENT DOCUMENTS

CN 104414487 A 3/2015
CN 204232975 U 4/2015
CN 205083309 U 3/2016
EP 1764012 A1 3/2007
JP 2012220146 A 11/2012

* cited by examiner

*Primary Examiner* — James O Hansen
(74) *Attorney, Agent, or Firm* — Dority & Manning, P.A.

(57) ABSTRACT

A drawer glide includes a main body, the main body including a base which defines an X-axis and a Y-axis perpendicular to the X-axis, and a front face extending from the base along a Z-axis perpendicular to the X-axis and the Y-axis; and a slide extension extending from the base along the Z-axis, the slide extension located at a rear of the base distal the front face. The slide extension extends in an opposite direction along the Z-axis from the front face, and the slide extension defines a hook including a first tab extending along the X-axis and a second tab extending along the Z-axis.

16 Claims, 6 Drawing Sheets

DRAWER GLIDE FOR OVEN BOTTOM DRAWER

FIELD OF THE INVENTION

The present subject matter relates generally to drawer glides, and more particularly to drawer glides for under-oven mounted drawers.

BACKGROUND OF THE INVENTION

Conventional ovens are household appliances used to cook or reheat food items or cooking utensils, such as baking dishes or pans. Users may store certain cooking utensils in convenient places for ease of access. For instance, some conventional ovens include a drawer underneath an oven cavity, such as to store pots, pans, or other utensils. The drawer may be configured to slide into and away from a space below the oven cavity, for instance, along one or more rails. Accordingly, certain features, such as drawer slides or glides, that aid in the sliding ability of the drawer are required.

Existing slides for aiding in sliding of drawers exhibit certain drawbacks. For instance, conventional glides are attached to either a side of a drawer or a bottom of a drawer. These locations increase an overall width or depth of the drawer, complicating both an assembly of the oven and any required maintenance to the drawer or the conventional glide. Further, conventional designs result in a decreased oven capacity, a decreased drawer capacity, or both. Accordingly, a drawer glide with features that obviate one or more of the aforementioned drawbacks would be useful. In particular, a drawer glide with improved stability and ease of installation would be beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a drawer glide is provided. The drawer glide may include a main body, the main body comprising a base which defines an X-axis and a Y-axis perpendicular to the X-axis, and a front face extending from the base along a Z-axis perpendicular to the X-axis and the Y-axis; and a slide extension extending from the base along the Z-axis, the slide extension located at a rear of the base distal the front face, wherein the slide extends in an opposite direction along the Z-axis from the front face, and wherein the slide extension defines a hook comprising a first tab extending along the X-axis and a second tab extending along the Z-axis.

In another exemplary aspect of the present disclosure, a drawer assembly is provided. The drawer assembly may include a drawer body comprising a main panel, a rear panel connected to the main panel, and first and second side panels connected to the main panel and the rear panel; and a drawer glide mountable to the rear panel. The drawer glide may include a main body, the main body including a base which defines an X-axis and a Y-axis perpendicular to the X-axis, and a front face extending from the base along a Z-axis perpendicular to the X-axis and the Y-axis; and a slide extension extending from the base along the Z-axis, the slide extension located at a rear of the base distal the front face, wherein the slide extensions in an opposite direction along the Z-axis from the front face, and wherein the slide extension defines a hook comprising a first tab extending along the X-axis and a second tab extending along the Z-axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
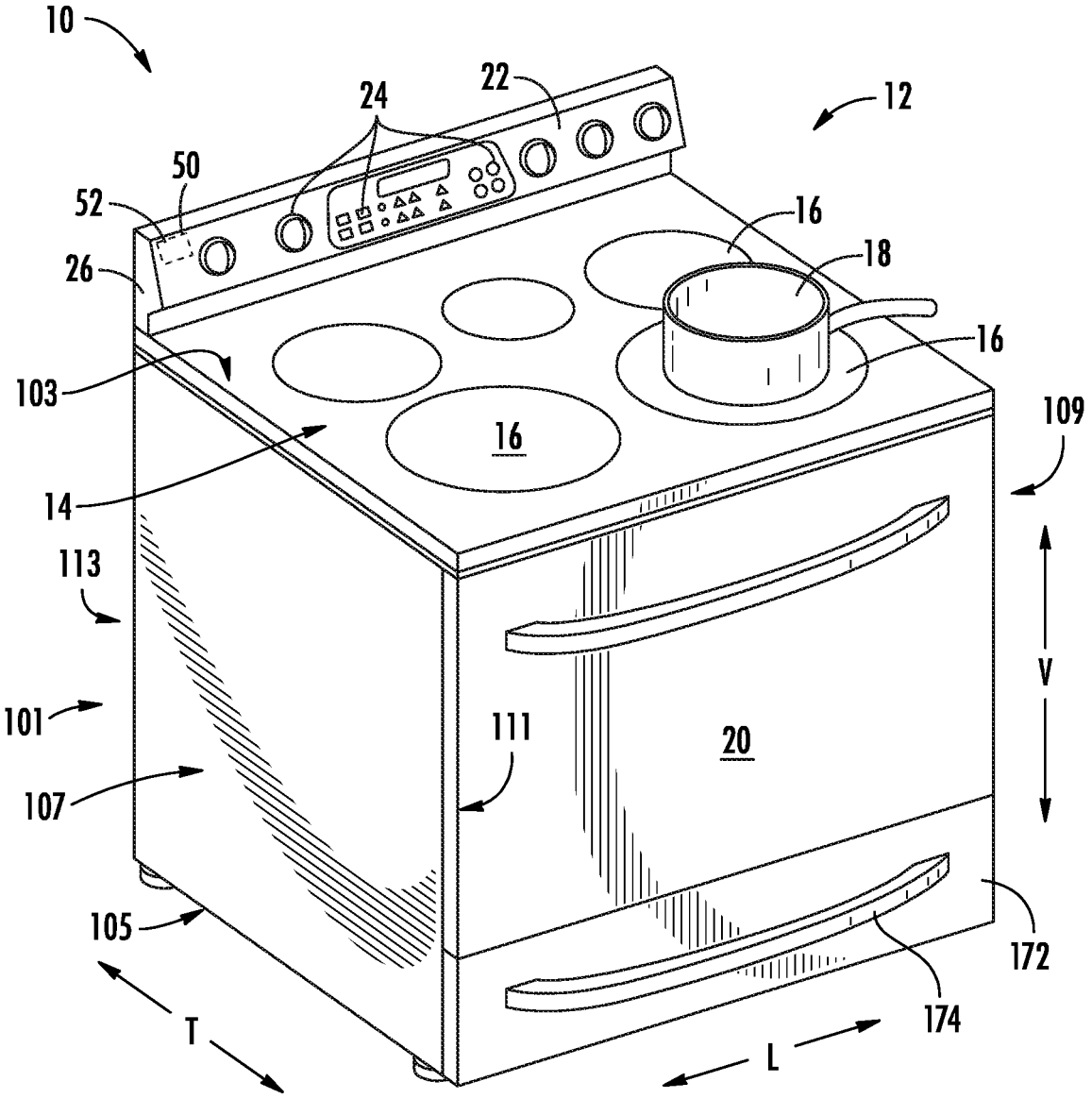
FIG. 1 provides a perspective view of an oven range according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
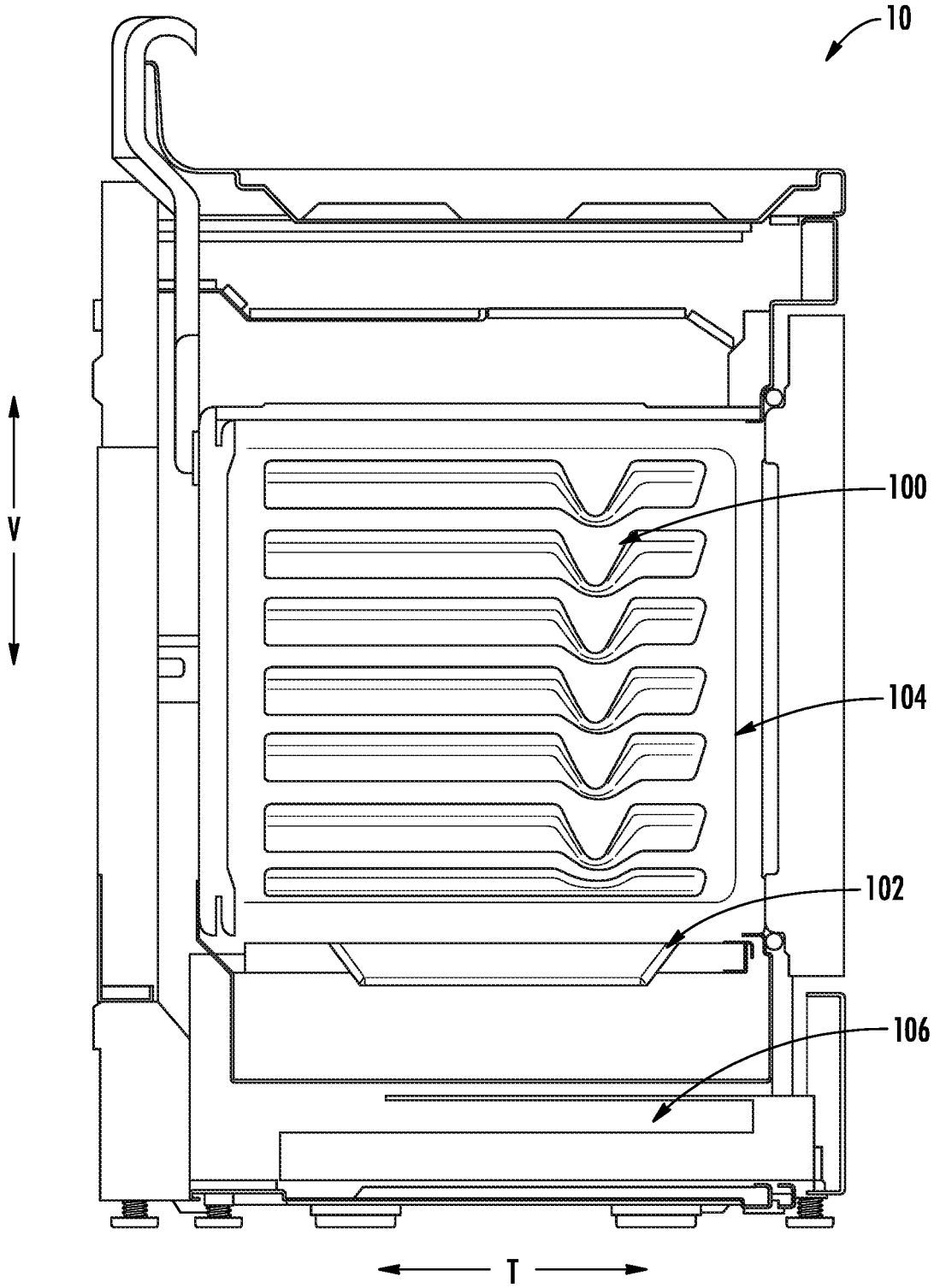
FIG. 2 provides a side cut-away view of the exemplary oven range of FIG. 1.

FIG. 1 provides a perspective view of a range appliance, or oven range 10, including a cooktop 12, and FIG. 2 provides a side cut-away view of the range appliance. Oven range 10 is provided by way of example only and is not intended to limit the present subject matter to the arrangement shown in FIGS. 1 and 2. Thus, the present subject matter may be used with other range 10 and/or cooktop 12 configurations, e.g., double oven range appliances. As illustrated, oven range 10 generally defines a vertical direction V, a lateral direction L, and a transverse direction T, each of which is mutually perpendicular, such that an orthogonal coordinate system is generally defined. Oven range 10 includes a cabinet 101 that extends between a top 103 and a bottom 105 along the vertical direction V, between a left side 107 and a right side 109 along the lateral direction, and between a front 111 and a rear 113 along the transverse direction T.

A cooking surface 14 of cooktop 12 includes a plurality of heating elements 16. For the embodiment depicted, the cooktop 12 includes five heating elements 16 spaced along cooking surface 14. The heating elements 16 are generally electric heating elements and are positioned at, e.g., on or proximate to, the cooking surface 14. In certain exemplary embodiments, cooktop 12 may be a radiant cooktop with resistive heating elements or coils mounted below cooking surface 14. However, in other embodiments, the cooktop appliance 12 may include any other suitable shape, configuration, and/or number of heating elements 16, for example, the cooktop 12 may be an open coil cooktop with the heating elements 16 positioned on or above surface 14. Additionally, in other embodiments, the cooktop 12 may include any other suitable type of heating element 16, such as an induction heating element. Each of the heating elements 16 may be the same type of heating element 16, or cooktop 12 may include a combination of different types of heating elements 16.

As shown in FIG. 1, a cooking utensil 18, such as a pot, pan, or the like, may be placed on a heating element 16 to heat the cooking utensil 18 and cook or heat food items placed in cooking utensil 18. Range appliance 10 also includes a door 20 that permits access to a cooking chamber 104 of oven range 10, e.g., for cooking or baking of food items therein. A control panel 22 having controls 24 permits a user to make selections for cooking of food items. Although shown on a backsplash or back panel 26 of oven range 10, control panel 22 may be positioned in any suitable location. Controls 24 may include buttons, knobs, and the like, as well as combinations thereof, and/or controls 24 may be implemented on a remote user interface device such as a smartphone, as described below. As an example, a user may manipulate one or more controls 24 to select a temperature and/or a heat or power output for each heating element 16 and the cooking chamber 104. The selected temperature or heat output of heating element 16 affects the heat transferred to cooking utensil 18 placed on heating element 16.

The cooktop appliance 12 includes a control system 50 for controlling one or more of the plurality of heating elements 16 and the cooking chamber 104. Specifically, the control system 50 may include a controller 52 operably connected to the control panel 22 and controls 24. The controller 52 may be operably connected to each of the plurality of heating elements 16 for controlling a power supply to each of the plurality of heating elements 16 in response to one or more user inputs received through the control panel 22 and controls 24.

The cooktop appliance 12 may include a drawer recess 106, into which a drawer assembly 108 (described in more detail below) may be inserted. Drawer recess 106 may be provided underneath cooking chamber 104, for example. A user may store various items (e.g., cooking utensils 18 or the like) within drawer recess 106. An opening to drawer recess 106 may be defined in the lateral direction L and vertical direction V. In detail, drawer recess 106 may be configured such that drawer assembly 108 is withdrawn in the transverse direction T from drawer recess 106.

One or more drawer slide rails 118 may be located within drawer recess 106. Drawer slide rail 118 may be arranged in the transverse direction T. In other words, drawer slide rail 118 may be orientated such that drawer assembly 108 slides along drawer slide rail 118 along the transverse direction T. The one or more drawer slide rails 118 may include a first drawer slide rail 118 provided at a first lateral side of drawer recess 106 and a second drawer slide rail 118 provided at a second lateral side of drawer recess 106. However, it should be appreciated that any suitable number of drawer slide rails 118 may be provided within drawer recess 106.

Drawer slide rail 118 may include a horizontal portion 1062 and a vertical portion 1064. Horizontal portion 1062 may protrude in the lateral direction L and extend in the transverse direction T. Vertical portion 1064 may protrude from a distal end of horizontal portion 1062 in the vertical direction V (e.g., downward), and extend in the transverse direction T. Accordingly, drawer slide rail may have an "L" shaped cross-section in a plane defined in the lateral direction L and the vertical direction V.

Figure 6:
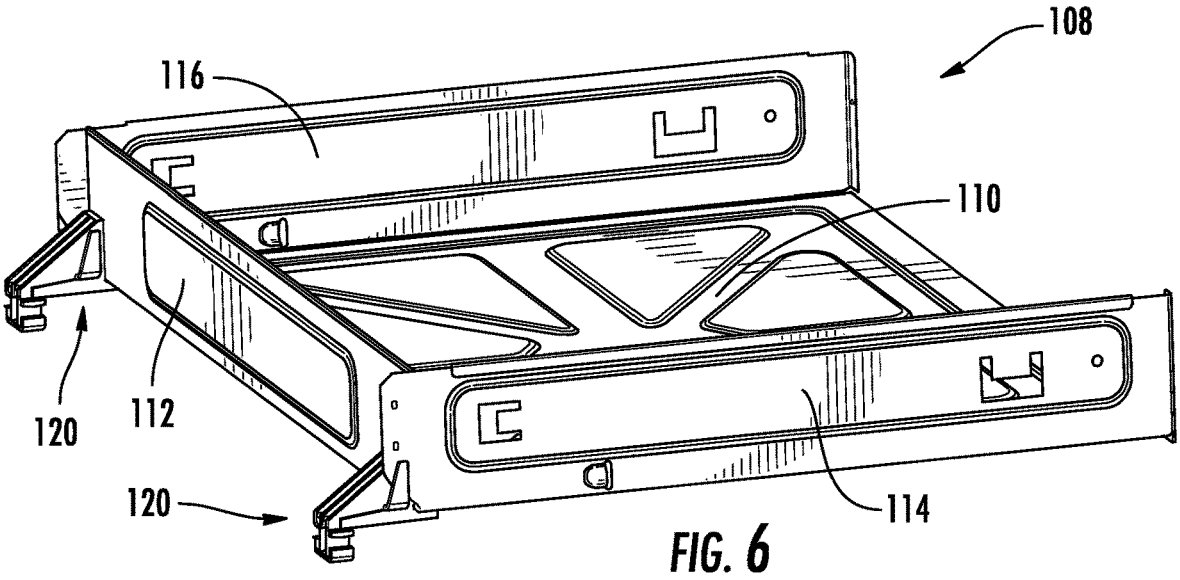
FIG. 6 provides a perspective view of the exemplary drawer assembly of FIG. 3.

Drawer assembly 108 may include a main panel 110, a rear panel 112, a first side panel 114, and a second panel 116. Accordingly, main panel 110, rear panel 112, first side panel 114, and second side panel 116 may form a drawer body having a cuboid shape into which various items may be placed. Drawer assembly 108 may include a front panel or door face 172 including a handle 174 (FIG. 1) used to withdraw and insert drawer assembly 108 into drawer recess 106. When assembled, first side panel 114 and second side panel 116 may be defined in the transverse direction T and the vertical direction V. Rear panel 112 may be defined in the lateral direction L and the vertical direction V. Main panel 110 may be defined in the lateral direction L and the transverse direction T. A rear portion of each of first side panel 114 and second side panel 116 may extend further in the transverse direction T than a position of rear panel 112. In other words, each of first side panel 114 and second side panel 116 may define an overhang or extension in the transverse direction (e.g., behind rear panel 112 in the transverse direction T, as seen in FIG. 6).

Figure 3:
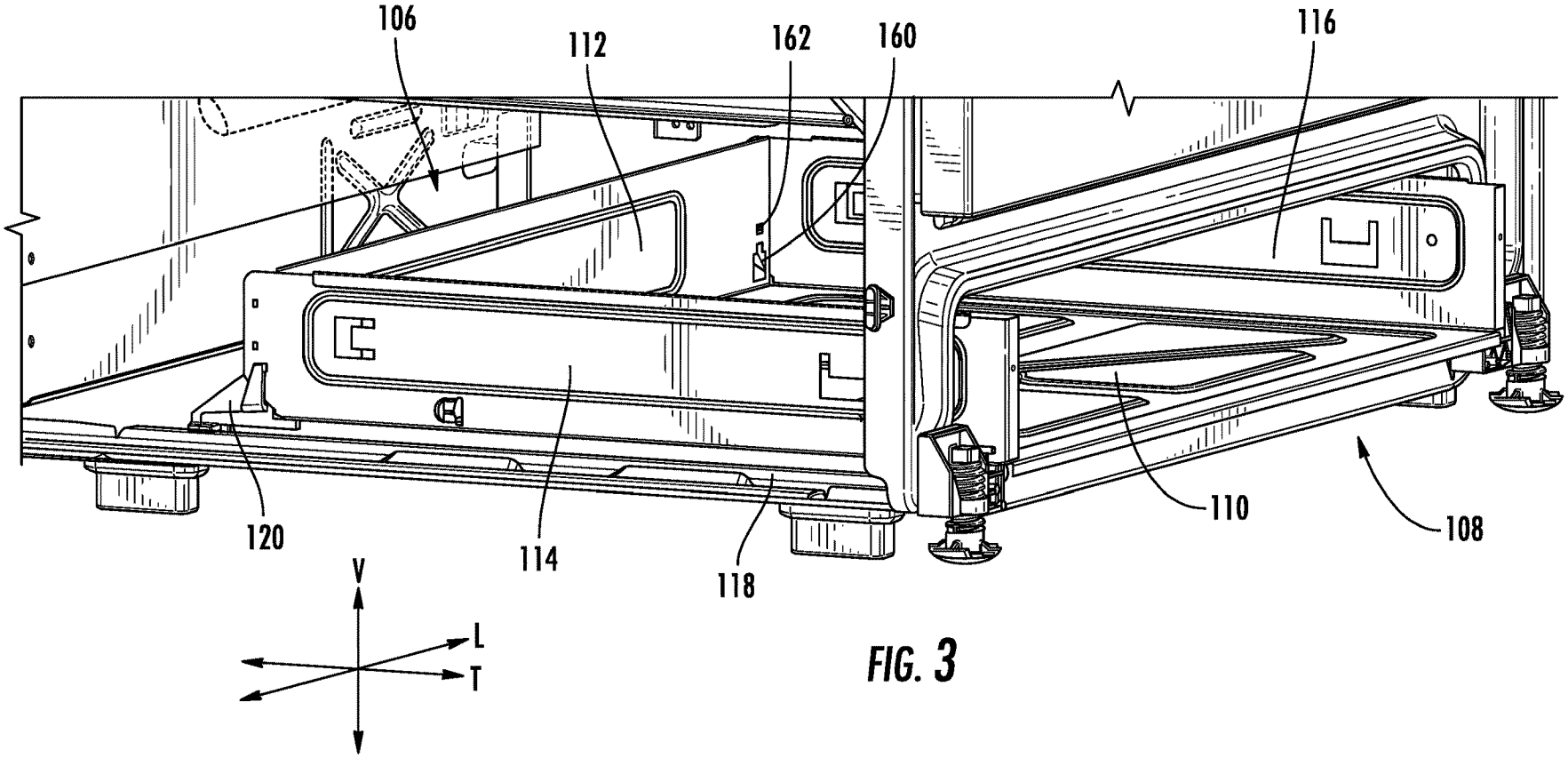
FIG. 3 provides a perspective cut-away view of a drawer assembly of the exemplary oven range of FIG. 1.
Figure 7:
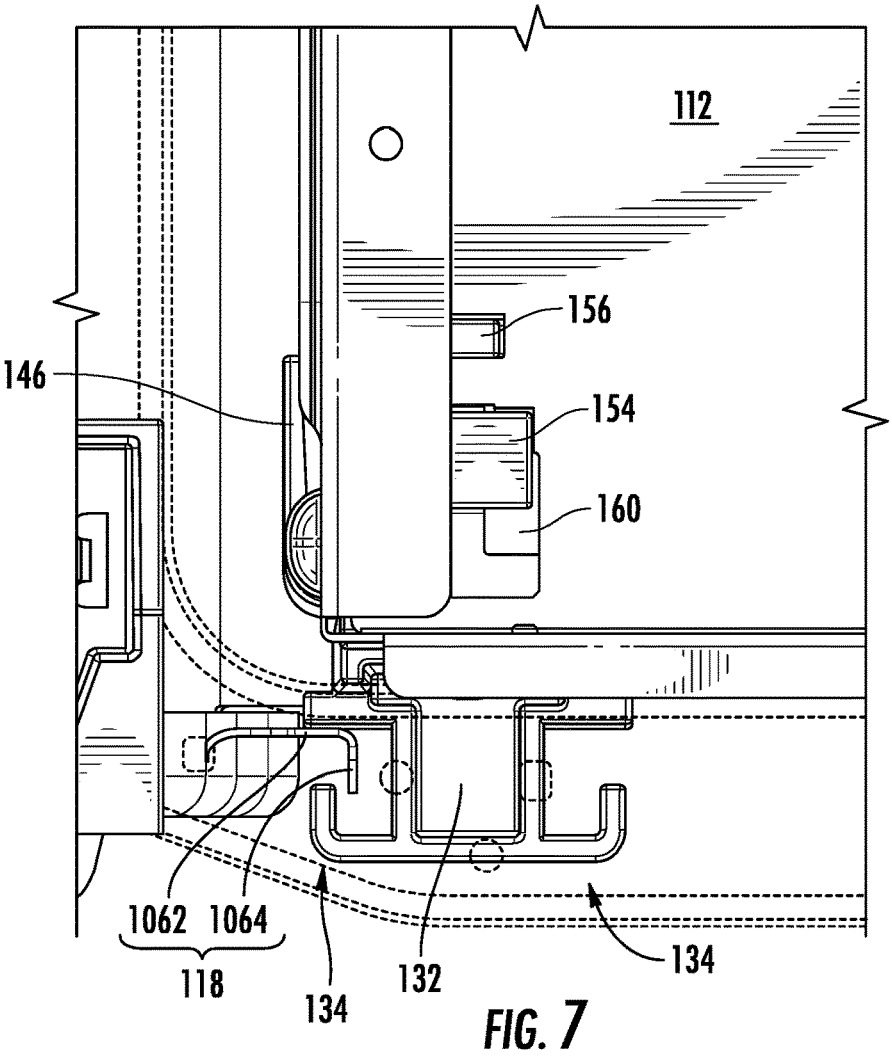
FIG. 7 provides a front cut-away view of the exemplary drawer glide of FIG. 4 attached to a rail.

A latch hole 160 may be defined in rear panel 112 of drawer assembly 108. Latch hole 160 may be configured to accept and hold a first protrusion 154 (described below) of drawer glide 120 (also described below). As best seen in FIGS. 3 and 7, latch hole 160 may be located at or near a bottom of rear panel 112. Latch hole 160 may be predominantly square in shape. Additionally or alternatively, latch hole 160 may include one or more tabs that protrude from a top corner of latch hole 160 in the lateral direction L and vertical direction V. However, the geometry of latch hole 160 is not limited to that discussed herein, and any suitable shape may be used.

A catch hole 162 may be defined in rear panel 112 of drawer assembly 108. Catch hole 162 may be positioned above latch hole 160 (e.g., in the vertical direction V). Catch hole 162 may be configured to accept a second protrusion 156 (described below) of drawer glide 120. Catch hole 162 may be predominantly square in shape. However, the geometry of catch hole 162 is not limited to that discussed herein, and any suitable shape may be used.

Referring generally to FIGS. 4 through 8, a drawer glide 120 is disclosed. Herein, drawer glide 120 will be defined within an XYZ coordinate system (e.g., an X-axis, a Y-axis, and a Z-axis). In some embodiments, the X-axis corresponds to the lateral direction L, the Y-axis corresponds to the transverse direction T, and the Z-axis corresponds to the vertical direction V. However, an orientation of drawer glide 120 within the lateral, transverse, and vertical directions may not be fixed. Drawer glide 120 may be attachable to drawer assembly 108 to assist in a sliding motion of drawer assembly 108 within drawer recess 106.

Drawer glide 120 may include a main body 122 which defines a base 124. Base 124 may have a panel shape defined along the X-axis and the Y-axis. A length of base 124 along the Y-axis may be longer than a length of base 124 along the X-axis. Additionally or alternatively, base 124 may include one or more stiffening ribs 168 that protrude from a bottom face of base 124 and extend along the Y-axis. Base 124 may include a first portion 126 and a second portion 128. First portion 126 may be longer than second portion 128 (e.g., along the Y-axis). First portion 126 may be located behind second portion 128 (e.g., along the Y-axis).

Main body 122 may include a front face 130. Front face 130 may be defined along the X-axis and the Z-axis. Front face 130 may extend from base 124 (e.g., along the Z-axis). For instance, front face 130 may extend from a top face of base 124 (e.g., opposite stiffening ribs 168). A length of front face 130 along the Z-axis may be greater than a width of front face 130 along the X-axis. Front face 130 may include one or more apertures defined therethrough. For instance, a first aperture 164 and a second aperture 166 may be defined through front face 130 (e.g., along the Y-axis). First aperture 164 may be provided on one side of front face (e.g., along the X-axis), while second aperture 166 may be provided adjacent to first aperture 164 (e.g., along the X-axis). Thus, a support post 170 may be defined between first aperture 164 and second aperture 166. Support post 170 may extend along the Z-axis through front face 130.

A first protrusion 154 may extend from front face 130 (e.g., along the Y-axis). For instance, first protrusion 154 may be attached to support post 170. First protrusion 154 may be predominantly cuboid in shape. Accordingly, first protrusion 154 may have a width along the X-axis such that first protrusion 154 overlaps with each of first aperture 164 and second aperture 166 (e.g., along the Y-axis). First protrusion 154 may be configured to be inserted into latch hole 160 in rear panel 112. As seen predominantly in FIG. 7, first protrusion 154 may be inserted into latch hole 160 from a rear of rear panel 112 (e.g., along the Y-axis or transverse direction T). Accordingly, a portion of rear panel 112 may be sandwiched between first protrusion 154 and front face 130 (i.e., between first protrusion 154 and first and second apertures 164, 166). A second protrusion 156 may extend from front face 130 (e.g., along the Y-axis). Second protrusion 156 may be located above first protrusion 154 (e.g., along the Z-axis). Second protrusion 156 may be located at or near a top of front face 130. Second protrusion 156 may be configured to be inserted into catch hole 162 in rear panel 112. In other words, when first protrusion 154 is inserted into latch hole 160 and slid upward (e.g., along the Z-axis or in the vertical direction V), second protrusion 156 may be inserted into catch hole 162. Accordingly, drawer glide 120 may be locked into place on rear panel 112.

Additionally or alternatively, a fastener (e.g., screw, rivet, bolt, adhesive, or the like) may be used to connect drawer glide 120 to drawer assembly 108. The fastener (or fasteners) may be used in addition to first protrusion 154 and second protrusion 156. The fastener may pass through one or more of side panel 114, side panel 116, or rear panel 112. Accordingly, additional stability may be provided between drawer glide 120 and drawer assembly 108.

Drawer glide 120 may include a slide extension 132. Slide extension 132 may protrude from the bottom face of base 124 (e.g., along the Z-axis). Slide extension 132 may be located at or near a rear of base 124 (i.e., at a distal end of first portion 126). Slide extension 132 may extend in an opposite direction from front face 130 (e.g., along the Z-axis). Slide extension 132 may include a hook 134 defined thereon. Hook 134 may include a first tab 136 protruding from slide extension 132 along the X-axis. First tab 136 may be located at a bottom (or distal) portion of slide extension 132 (e.g., distal to base 124). First tab 136 may extend along the Y-axis. Accordingly, first tab 136 may be predominantly parallel to base 124. Hook 134 may include a second tab 138 protruding from first tab 136 along the Z-axis. For instance, second tab 138 may protrude upward (e.g., toward base 124) from first tab 136. Second tab 138 may extend along the Y-axis. Second tab 138 may be predominantly perpendicular to first tab 136. Accordingly, first tab 136 and second tab 138 may collectively form and define hook 134.

Figure 5:
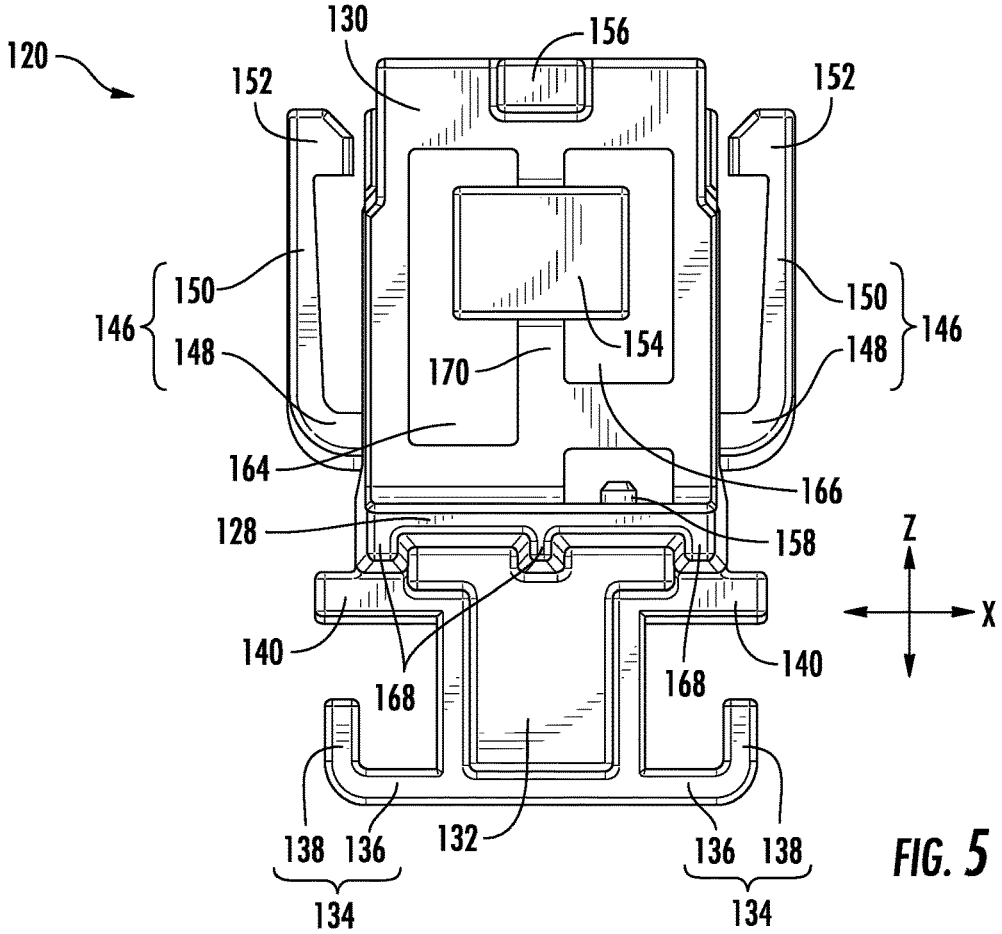
FIG. 5 provides a front view of the exemplary drawer glide of FIG. 4.

Slide extension 132 may further include a slide tab 140. Slide tab 140 may protrude from slide extension 132 along the X-axis proximal to base 124. Slide tab 140 may extend along the Y-axis. Slide tab 140 may be predominantly parallel to first tab 136 of hook 134. Additionally or alternatively, slide tab 140 may be spaced apart from a distal end of second tab 138. A bottom face of slide tab 140 may be convex (e.g., along the Z-axis). As will be described in more detail below, slide tab 140 may be configured to contact and slide along drawer slide rail 118 within drawer recess 106. As shown in FIG. 5, slide extension 132 may be mirrored about a plane defined along the Y-axis and the Z-axis. Accordingly, hook 134 may be provided on each of a first side and a second side of slide extension 132 (e.g., along the X-axis). Each hook 134 may be substantially similar, and as such a repeat description will be forgone for brevity.

Main body 122 of drawer glide 120 may further include a first side wall 142 and a second side wall 144. First side wall 142 may extend in the Y-axis and the Z-axis. First side wall 142 may be provided at a first side of main body 122 (e.g., along the X-axis). In detail, first side wall 142 may connect base 124 with front face 130. First side wall 142 may have any suitable shape. For instance, first side wall 142 may taper toward a distal end thereof along the Y-axis. Second side wall 144 may extend in the Y-axis and the Z-axis. Second side wall 144 may be provided at a second side of main body 122 (e.g., along the X-axis), opposite first side wall 142. In detail, second side wall 144 may connect base 124 with front face 130. Second side wall 144 may have any suitable shape. For instance, second side wall 144 may taper toward a distal end thereof along the Y-axis.

Figure 4:
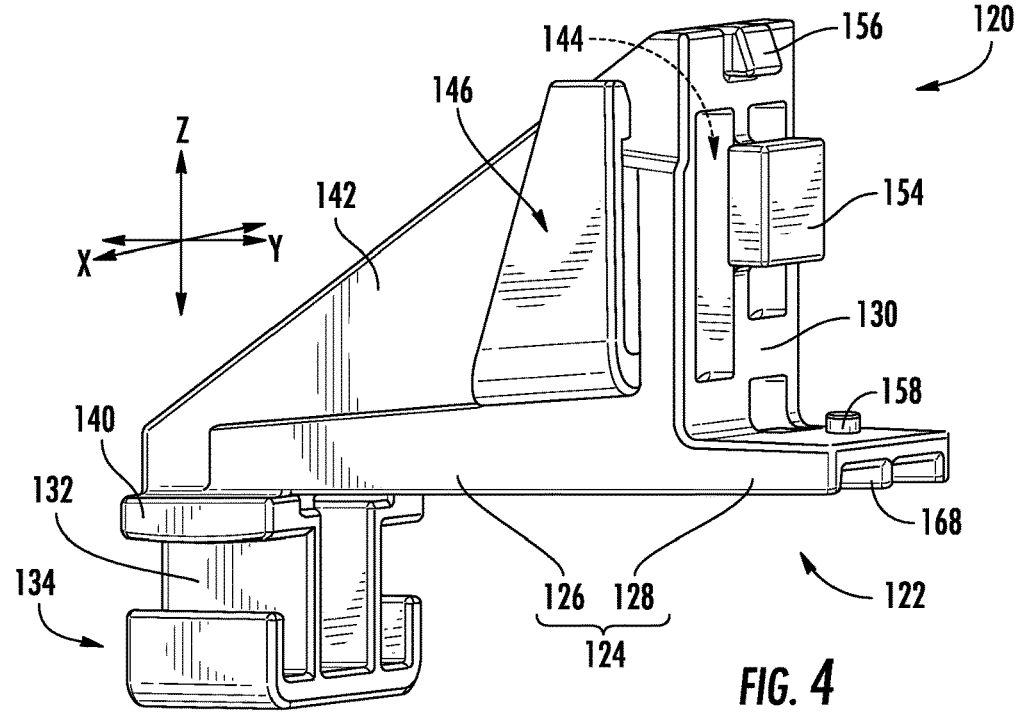
FIG. 4 provides a perspective view of an exemplary drawer glide according to exemplary embodiments of the present disclosure.

First side wall 142 may include a support arm 146. Support arm 146 may be attached to first side wall 142 near base 124. Support arm 146 may include a first portion 148. First portion 148 may protrude from first side wall 142 along the X-axis. First portion 148 may extend along the Y-axis (e.g., away from front face 130, as seen in FIG. 4). Support arm 146 may include a second portion 150. Second portion 150 may extend from first portion 148 along the Z-axis (e.g., in a direction away from base 124). Second portion 150 may be predominantly parallel to first side wall 142. When drawer glide 120 is attached to drawer assembly 108, second portion 150 of support arm 146 may be provided on a first lateral side (e.g., along the X-axis) of the extension (or overhang) of first side panel 114, while first side wall 142 may be provided on a second lateral side (e.g., along the X-axis) of the extension of first side panel 114. Accordingly, support arm 146 may provide additional lateral stability to drawer glide 120 with respect to drawer assembly 108. With specific reference to FIG. 6, it should be noted that drawer glide 120 may be attached to either first side panel 114 or second side panel 116 (or both first side panel 114 and second side panel 116). Thus, support arm 146 may protrude from each of first side wall 142 and second side wall 144 of main body 122 of drawer glide 120.

Additionally or alternatively, a catch 152 may protrude from a distal end of second portion 150 of support arm 146. Catch 152 may protrude along the X-axis from second portion 150. Catch 152 may protrude toward main body 122 of drawer glide 120. For example, catch 152 protruding from second portion 150 of support arm 146 attached to first side wall 142 protrudes toward first side wall 142, while catch 152 protruding from second portion 150 of support arm 146 attached to second side wall 144 protrudes toward second side wall 144. Catch 152 may ensure constant contact of main body 122 and support arm 146 with drawer assembly 108 (e.g., first side panel 114 or second side panel 116). As described above, support arm 146 may be provided in addition to a fastener (e.g., screw, rivet, bolt, adhesive, or the like) to increase stability between drawer glide 120 and drawer assembly 108.

A locator pin 158 may protrude from second portion 128 of base 124. For instance, locator pin 158 may protrude along the Z-axis from a top face of second portion 128. Locator pin 158 may have a cylindrical shape with an axis oriented normal to the top face of second portion 128. However, the shape of locator pin 158 is not limited, and any suitable shape may be used for locator pin 158. Locator pin 158 may assist in locating a position of drawer glide 120 with drawer assembly 108. In some embodiments, locator pin 158 fits into a locator hole or slot defined in main panel 110 of drawer assembly 108. Additionally or alternatively, locator pin 158 may fit into a groove formed into a bottom face of main panel 110 of drawer assembly 108.

Figure 8:
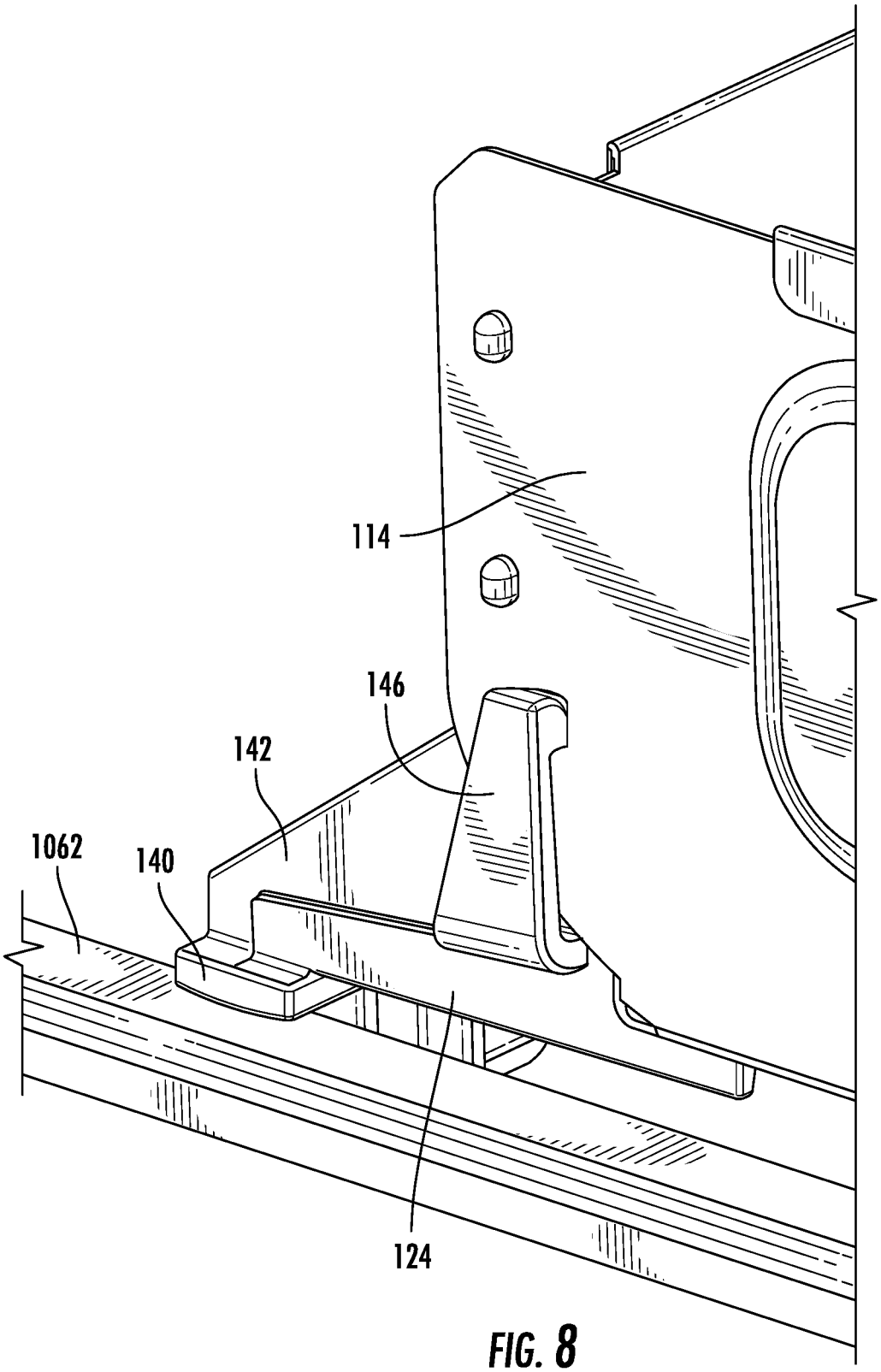
FIG. 8 provides a perspective view of the exemplary drawer glide of FIG. 7.

With reference to FIGS. 6 through 8, drawer glide 120 is shown connected to drawer slide rail 118. As shown, slide extension 132 may extend below the bottom face of main panel 110. Accordingly, in order to allow drawer assembly 108 and drawer glide 120 to fit into drawer recess 106, slide extension 132 may be positioned a predetermined distance aft rear panel 112. Thus, a first portion of drawer glide 120 (e.g., first portion 126 of base 124 including slide extension 132) may be inserted into drawer recess 106. Subsequently, drawer assembly 108 may be lowered to allow rear panel 112 and first and second side panels 114, 116 to enter drawer recess 106. In detail, drawer assembly 108 may be lowered until slide tab 140 contacts drawer slide rail 118 (e.g., horizontal portion 1062). In some embodiments, a gap may be provided in horizontal portion 1062 to allow hook 134 to pass through drawer slide rail 118. Thus, when drawer assembly 108 is moved further into drawer recess 106, vertical portion 1064 of drawer slide rail 118 may be positioned between second tab 138 of hook 134 and slide extension 132. Accordingly, drawer glide 120 may be restricted from becoming displaced on drawer slide rail 118 (e.g., along the X-axis or in the lateral direction L).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A drawer glide comprising:

a main body, the main body comprising a base which defines an X-axis and a Y-axis perpendicular to the X-axis, a front face extending from the base along a Z-axis perpendicular to the X-axis and the Y-axis, and a first side wall and a second side wall parallel to and opposite the first side wall, the first and second side walls extending along the Y-axis and the Z-axis and connecting the base to the front face;

a support arm attached to the first side wall, the support arm comprising a first portion protruding from the first side wall along the X-axis and a second portion protruding from the first portion along the Z-axis; and a slide extension extending from the base along the Z-axis, the slide extension located at a rear of the base distal the front face, wherein the slide extension extends in an opposite direction along the Z-axis from the front face, wherein the slide extension defines a hook comprising a first tab extending along the X-axis from the slide extension and a second tab extending along the Z-axis from a distal end of the first tab, the second tab being parallel with the slide extension, and wherein the slide extension further defines a slide tab extending along the X-axis, the slide tab being located above the first tab along the Z-axis.

2. The drawer glide of claim 1, wherein the support arm comprises a catch protruding from a distal end of the second portion along the X-axis toward the first side wall.

3. The drawer glide of claim 1, further comprising:

a first protrusion extending from the front face along the Y-axis; and a second protrusion extending from the front face along the Y-axis and located above the first protrusion along the Z-axis.

4. The drawer glide of claim 3, further comprising a plurality of apertures defined in the front face along the Y-axis, wherein the first protrusion overlaps the plurality of apertures along the Y-axis.

5. The drawer glide of claim 1, wherein the base comprises:

a first portion extending in a first direction along the Y-axis from the front face; and a second portion extending in a second direction opposite the first direction along the Y-axis from the front face, wherein the first portion is longer than the second portion along the Y-axis.

6. The drawer glide of claim 5, further comprising a locator pin extending along the Z-axis from the second portion of the base.

7. The drawer glide of claim 1, wherein the drawer glide is mountable to a rear panel of a sliding drawer, such that the slide extension is located a predetermined distance away from the rear panel of the sliding drawer along the Y-axis.

8. The drawer glide of claim 7, wherein the sliding drawer is mountable to an oven appliance.

9. A drawer assembly defining a vertical direction, a lateral direction, and a transverse direction, the drawer assembly comprising:

a drawer body comprising a main panel, a rear panel connected to the main panel, and first and second side panels connected to the main panel and the rear panel; and a drawer glide mountable to the rear panel, the drawer glide comprising:

a main body, the main body comprising a base which defines an X-axis and a Y-axis perpendicular to the X-axis, and a front face extending from the base along a Z-axis perpendicular to the X-axis and the Y-axis;

a first protrusion extending from the front face along the Y-axis;

a second protrusion extending from the front face along the Y-axis and located above the first protrusion along the Z-axis; and a slide extension extending from the base along the Z-axis, the slide extension located at a rear of the base distal the front face, wherein the slide extension extends in an opposite direction along the Z-axis from the front face, and wherein the slide extension defines a hook comprising a first tab extending along the X-axis and a second tab extending along the Z-axis.

10. The drawer assembly of claim 9, wherein the slide extension further defines a slide tab extending along the X-axis direction, the slide tab being located above the first tab along the Z-axis.

11. The drawer assembly of claim 9, further comprising a plurality of apertures defined in the front face along the Y-axis, wherein the first protrusion overlaps the plurality of apertures along the Y-axis.

12. The drawer assembly of claim 11, wherein the rear panel of the drawer body defines a latch hole configured to receive the first protrusion and a catch hole configured to receive the second protrusion.

13. The drawer assembly of claim 9, wherein the base comprises:

a first portion extending in a first direction along the Y-axis from the front face; and a second portion extending in a second direction opposite the first direction along the Y-axis from the front face, wherein the first portion is longer than the second portion.

14. The drawer assembly of claim 13, further comprising a locator pin extending along the Z-axis from the second portion of the base.

15. The drawer assembly of claim 9, further comprising a support arm attached to the drawer glide, the support arm comprising a first portion extending from the drawer glide along the X-axis and a second portion extending from the first portion along the Z-axis, wherein the first side panel of the drawer body is sandwiched between the support arm and the drawer glide.

16. The drawer assembly of claim 9, wherein the drawer body is mountable to an oven appliance.

* * * * *